United States Patent [19]

Phillips

[11] 4,392,808

[45] Jul. 12, 1983

[54] SPINNERET ORIFICE CROSS-SECTIONS

[75] Inventor: Bobby M. Phillips, Kingsport, Tenn.

[73] Assignee: Eastman Kodak Company, Rochester, N.Y.

[21] Appl. No.: 390,571

[22] Filed: Jun. 21, 1982

[51] Int. Cl.[3] ..... B29H 7/18

[52] U.S. Cl. ..... 425/464; 425/465; 264/147; 264/177 F

[58] Field of Search ..... 428/397; 264/177 F, 264/147; 425/464, 465

[56] References Cited

U.S. PATENT DOCUMENTS 2,000,388 5/1938 Hofstadt ..... 264/177 F 3,109,195 4/1963 Combs et al. ..... 264/177 F 4,332,761 6/1982 Phillips et al. ..... 264/177 F

*Primary Examiner*—Jay H. Woo

*Attorney, Agent, or Firm*—Malcolm G. Dunn; Daniel B. Reece, III

[57] ABSTRACT

Spinneret orifices the planar cross-section of which defines an elongated slot having a plurality of wing member bar slots intersecting with the elongated slot at spaced intervals along the axial length thereof, and multiple intersecting body section bar slots intersecting with the elongated slot and intersecting with each of the other multiple intersecting body section bar slots at the elongated slot.

24 Claims, 20 Drawing Figures

$$\text{and } H(x) = \int_{-x}^{+x} \frac{\alpha}{2} e^{-[\alpha \frac{(x+z)}{2} + \frac{2\beta}{(x+z)}]} \cdot R \frac{(x-z)}{2} dz$$

and $R(\xi)$ is the log normal probability density function whose mean is $\mu_2 + \ln w$ and variance is $\sigma_2^2$
or
where $\mu_2$ = mean value of $\ln(\mathrm{COT}\theta)$
with $\theta$ = angle at which tearing break makes to fiber axis
and
w = width of the wing
or $$R(\xi) = \frac{1}{\xi\sigma_2\sqrt{2\pi}} e^{[-\frac{1}{2}(\frac{\ln\xi - \ln w - \mu_2}{\sigma_2})^2]}$$

and for
$\mu_2 = 3.096$
$\sigma_2 = 0.450$
$0.11\ \mathrm{mm}^{-1} \leqq \alpha \leqq 2.06\ \mathrm{mm}^{-1}$
$0 \leqq \beta \leqq 1.25\ \mathrm{mm}^{-1}$ $0.0085\ \mathrm{mm} \leqq w \leqq 0.0173\ \mathrm{mm}$ The free protruding ends have a preferential direction of protrusion from the individual filaments and greater than 50% of the free protruding ends initially protrude from the body member in the same direction.

The mean length of the wing member portion of the bridge loops is about 0.2 to about 10.0 millimeters and the mean separation distance of the bridge loops along a filament is about 2 to about 50 millimeters. The bridge loops are randomly distributed along the filaments.

The yarns made from filaments spun from the spinneret orifice cross-sections of this invention herein described comprise continuous multifilaments of polyester, polyolefin or polyamide polymer, each having at least one body section and having extending therefrom along its length at least one wing member, the body section comprising about 25 to about 95% of the total mass of the filament and the wing member or wing members comprising about 5 to about 75% of the total mass of the filament, the filament being further characterized by a wing-body interaction (WBI) defined by $$WBI = \left[\frac{(Dmax - Dmin)\ Dmin}{2\ Rc^2}\right]\left[\frac{Lw}{Dmin}\right]^2 \geqq 10$$

where the ratio of the width of the filament cross-section to the wing member thickness ($L_T$/Dmin) is $\leqq 30$. The significance of the above symbols are discussed in U.S. Pat. No. 4,245,001. The body section of each filament remains continuous throughout the fractured yarn and thus provides load-bearing capacity whereas a fraction of the wing members are broken and provide the free protruding ends.

The filaments may have one or more wing members that are curved or the wing members may be angular; thus the spinneret orifices may be modified accordingly. The filaments may be provided with other luster-modifying means which may be finely dispersed $TiO_2$ or kaolin clay.

The filaments and yarns are preferably made from polyester or copolyester polymer. Polymers that are particularly useful are poly(ethylene terephthalate) and poly(1,4-cyclohexanedimethylene terephthalate). These polymers may be modified so as to be basic dyeable, light dyeable or deep dyeable as is known in the art. These polymers may be produced as disclosed in U.S. Pat. Nos. 3,962,189 and 2,901,466 and by conventional procedures well known in the art of producing fiber-forming polyesters. Also the filaments and yarns can be made from polymers such as poly(butylene terephthalate), polypropylene or nylon such as nylon 6 and 66. However, the making of yarns described herein from these polymers is more difficult than the polyesters mentioned above. I believe this is attributable to the increased difficulty in making these polymers behave in a brittle manner during the fracturing process.

DISCLOSURE OF INVENTION

In accordance with the present invention, I provide a spinneret defining at least one spinneret orifice the planar cross-section of which defines an elongated slot having a plurality of wing member bar slots intersecting with the elongated slot at spaced intervals along the axial length thereof, and multiple intersecting body section bar slots intersecting with the elongated slot and intersecting with each of the other multiple intersecting body section bar slots at the elongated slot.

A body section bar slot on one side of the elongated slot may be in straight line alignment with a body section bar slot on the other side of the elongated slot.

A body section bar slot may intersect the elongated slot at essentially right angles thereto or one of the two angles at the intersection may vary from about 30° to about 120°.

The multiple intersecting body section bar slots may also intersect at the center of the axial length of the elongated slot.

The multiple intersecting body section bar slots may intersect the elongated slot at a location spaced from the center of the axial length of the elongated slot.

The multiple intersecting body section bar slots each have a greater length than the wing member bar slots.

The number of multiple intersecting body section bar slots may vary from two to eight.

One or more of the body section bar slots may be nonstraight such as curved, or a portion of the length of at least one body section bar slot forms an angle with the remaining portion of the at least one body section bar slot of less than 180°.

The elongated slot may be nonstraight, such as being curved, or at an angle other than 180° with a portion or portions of its length.

The length of the elongated slot on one side of the multiple intersecting body section bar slots may form an angle of less than 180° with the length of the elongated slot on the other side of the multiple intersecting body section bar slots; and a portion of the length of the elongated slot on one or both sides of the elongated slot may form an angle of less than 180° with the adjacent remaining portion of such length.

A wing member bar slot on one side of the elongated slot may be in straight line alignment with a wing member bar slot on the other side of the elongated slot.

A wing member bar slot may intersect the elongated slot at essentially right angles thereto or one of the two angles at the intersection may vary from about 30° to about 120°.

The wing member bar slots intersecting with one side of the elongated slot may also be spaced at offset intervals with respect to the wing member bar slots intersecting with the other side of the elongated slot.

The number of wing member bar slots on one side of the multiple intersecting body section bar slots may

SPINNERET ORIFICE CROSS-SECTIONS

DESCRIPTION

This invention relates to spinneret orifice cross-sections having a special geometry so as to produce novel synthetic filaments for producing yarns, and particularly for producing other synthetic filaments and spun-like filament yarns having free protruding ends which come within the scope of U.S. Pat. No. 4,245,001.

BACKGROUND ART

The spinning of synthetic filaments by extrusion of certain materials through an orifice of some configuration is a generally accepted and well-known practice in textile manufacture. It is also known that certain desired physical properties may be attained for such synthetic filaments by spinning selected materials through spinneret orifice cross-sections that have been modified in some manner from round or nearly round transverse cross-sections that have been common for years. The cross-sections of filaments are designed for specific end uses, the formation of the cross-sections are in turn governed in part by the cross-sections of the spinneret orifices through which they are extruded.

Historically fibers used by man to manufacture textiles, with the exception of silk, were of short length. Vegetable fibers such as cotton, animal fibers such as wool, and bast fibers such as flax all had to be spun into yarns to be of value in producing fabrics. However, the very property of short staple length of these fibers requiring that the yarns made therefrom be spun yarns also resulted in bulky yarns having very good covering power, good insulating properties and a good, pleasing hand.

The operations involved in spinning yarns from staple fibers are rather extensive and thus are quite costly. For example, the fibers must be carded and formed into slivers and then be subsequently drawn to reduce the diameter and finally be spun into yarn.

The prior art discloses efforts to produce spun-like yarns from continuous filament yarns. See U.S. Pat. No. 4,245,001 for a more complete discussion of these efforts.

The present invention is directed to a spinneret that defines at least one spinneret orifice the planar cross-section of which defines an elongated slot having a plurality of wing member bar slots intersecting with the elongated slot at spaced intervals along the axial length thereof and having multiple intersecting body section bar slots intersecting with the elongated slot and intersecting with each of the other multiple intersecting body section bar slots at the elongated slot. The use intended is for melt spinning filaments and particularly for melt spinning multifilament, continuous filament yarns that, after subsequent processing, will have a spun-like character or a character similar to that achieved by spinning yarns from staple fibers but without involving all of the operations normally required for spinning yarns from staple fibers.

The term "wing member bar slot" serves to identify the bar slot responsible for creating lobes on the peripheral surface of the wing member of the filament cross-section extruded from the spinneret orifice.

The term "body section bar slot" serves to identify the bar slot responsible for creating lobes on the peripheral surface of the body section of such extruded filament cross-section.

The term "multiple intersecting," as applied to the body section bar slots, means that there is a multiple number (two or more) of such body section bar slots that not only intersect with each other but also such intersection occurs at the elongated slot, which is defined in the spinneret orifice cross-section.

The art discloses spinneret orifice cross-sections which show a plurality of bar slots intersecting with an elongated slot at spaced intervals along the axial length of the elongated slot, such as FIG. 12*a* in U.S. Pat. No. 3,156,085, with FIG. 12*b* illustrating the filament extruded from such spinneret orifice cross-section; and also such as the spinneret orifice illustrated in FIG. 5 of U.S. Pat. No. 3,109,195. U.S. Pat. No. 3,346,916 illustrates in FIG. 2 bar slots on one side of the elongated slot being offset with respect to the bar slots on the opposite side of the elongated slot. U.S. Pat. No. 3,156,085 also discloses a spinneret orifice being in the form of a star or having multiple intersecting bar slots such as illustrated in FIG. 9*a*. The filament cross-section extruded from such spinneret orifice is shown in FIG. 9*b*. None of the patents of which I am aware, however, disclose a spinneret orifice cross-section having a plurality of bar slots intersecting with an elongated slot at spaced intervals along the axial length of the elongated slot and also multiple intersecting bar slots intersecting with the elongated slot and intersecting with each of the other multiple intersecting bar slots at the elongated slot.

U.S. Pat. No. 4,245,001

Yarns made from the filament cross-sections spun from the spinneret orifice cross-sections disclosed in U.S. Pat. No. 4,245,001, as well as yarns spun from the spinneret orifice cross-sections of the present invention, have a spun yarn character, the yarn comprising a bundle of continuous filaments, the filaments having a continuous body section with at least one wing member extending from and along the body section, the wing member being intermittently separated from the body section, and a fraction of the separated wing members being broken to provide free protruding ends extending from the body section to provide the spun yarn character of the continuous filament yarn. The yarn is further characterized in that portions of the wing member are separated from the body section to form bridge loops, the wing member portion of the bridge loop being attached at each end thereof to the body section, the wing member portion of the bridge loop unexpectedly being shorter in length than the corresponding body section portion.

The free protruding ends extending from the filaments have a mean separation distance along a filament of about one to about ten millimeters and have a mean length of about one to about ten millimeters. The free protruding ends are randomly distributed along the filaments. The probability density function of the lengths of the free protruding ends on each individual filament is defined by $$f(x) = \frac{H(x)}{\int_0^\infty H(x)dx}, \; x > 0, \text{ otherwise } f(x) = 0$$

where f(x) is the probability density function vary from two to six when the wing member bar slots are so spaced at offset intervals along the elongated slot, and may vary from four to twelve when the wing member bar slots intersect the elongated slot on each side thereof with their respective intersections being directly opposite each other.

The number of wing member bar slots, $N_1$, along the axial length of the elongated slot on any one side of the multiple intersecting body section bar slots is 2 to 6 or 4 to 12, as heretofore described; and the number of multiple intersecting body section bar slots, $N_2$, is 2 to 8, and $W=0.050$ to $0.110$ mm.

$X_1=W$ to $3W$ $X_2=2W$ to $4W$ $X_3=W$ to $1.5W$ $X_4=1.5W$ to $3W$ $X_5=3.5W$ to $7.5W$ $X_6=3W$ to $7W$ $X_7=W$ to $1.5W$ $X_8=W$ to $2.5W$ $X_9=W$ to $2.5W$ $X_{10}=4W$ to $7W$ $X_{11}=2[W/2+X_1+X_3+(N_1-1)X_2+X_5]$

The extremities of the wing member bar slots and of the multiple intersecting body section bar slots define circular bores, and preferably the circular bores of the body section bar slots are of greater diameter than the circular bores of the wing member bar slots.

The spinneret orifice cross-sections disclosed herein spin a filament comprising at least one body section and having extending therefrom along its length at least one wing member, the wing member varying up to twice its minimum thickness along its width, the body section comprising about 25 to about 95% of the total mass of the filament and the wing member or wing members comprising about 5 to about 75% of the total mass of the filament, the filament being further characterized by a wing-body interaction defined by $$WBI = \left[\frac{(Dmax - Dmin)\,Dmin}{2\,Rc^2}\right]\left[\frac{Lw}{Dmin}\right]^2 \geqq 10$$

where the ratio of the width of the filament to the wing thickness ($L_T$Dmin) is $\leqq 30$.

Dmin is the thickness of the wing member for essentially uniform wing members and the minimum thickness close to the body section when the thickness of the wing member is variable. Note FIG. 2 herein.

Dmax is the thickness or diameter of the body section, as taken generally transversely across the elongated slot. See FIG. 2 herein.

$L_T$ is the overall length of the filament cross-section. Note FIG. 2 herein.

$L_W$ is the overall length of an individual wing member. Note FIG. 2 herein.

Rc is the radius of curvature of the intersection of the wing member and body section as shown in FIG. 2 herein.

The manner of measurement of the above-described parameters is more fully described in U.S. Pat. No. 4,245,001 in which I am one of the coinventors.

The wing member may be curved.

The wing member may be angular.

A portion of the wing member at the free edge thereof is of a greater thickness than the remainder of the wing member.

The wing members may be located on opposite sides of the "body sections."

The filament may have one or more wing members.

BRIEF DESCRIPTION OF DRAWINGS

The details of my invention will be described in connection with the accompanying drawings in which.

BEST MODE FOR CARRYING OUT THE INVENTION

Figure 3:
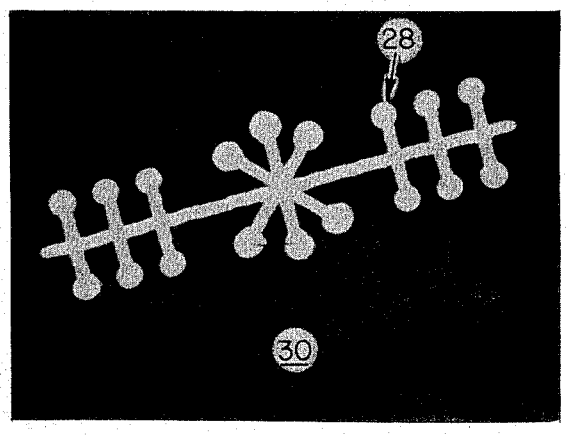
FIG. 3 is a photomicrograph of an embodiment of a spinneret orifice in a spinneret.
Figure 4:
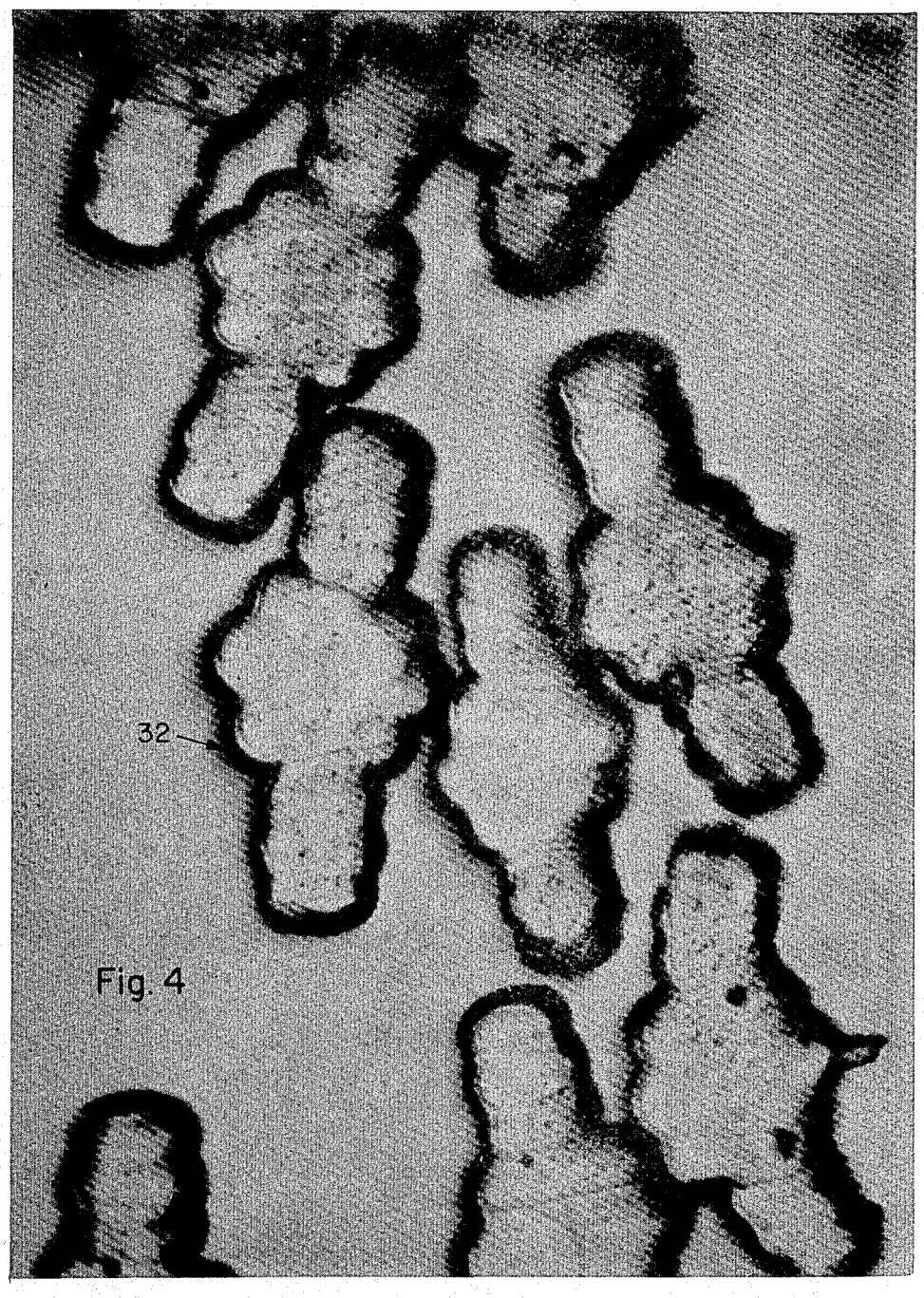
FIG. 4 is a photomicrograph of a filament cross-section of a filament spun from the spinneret orifice shown in FIG. 3.

In reference to the drawings, I show in FIG. 3 a photomicrograph of a portion of a spinneret having a spinneret orifice of this invention, and in FIG. 4 a photomicrograph of some typical filaments spun from this spinneret orifice. It is critical that the cross-section of the filaments have geometrical features which are further characterized by a wing-body interaction (WBI) defined by $$WBI = \left[\frac{(Dmax - Dmin)\,Dmin}{2\,Rc^2}\right]\left[\frac{Lw}{Dmin}\right]^2 \geqq 10$$

where the ratio of the width of the filament cross-section to the wing member thickness ($L_T$/Dmin) is $\leqq 30$. The identification of and procedure for measuring these features is described in U.S. Pat. No. 4,245,001.

Figure 1:
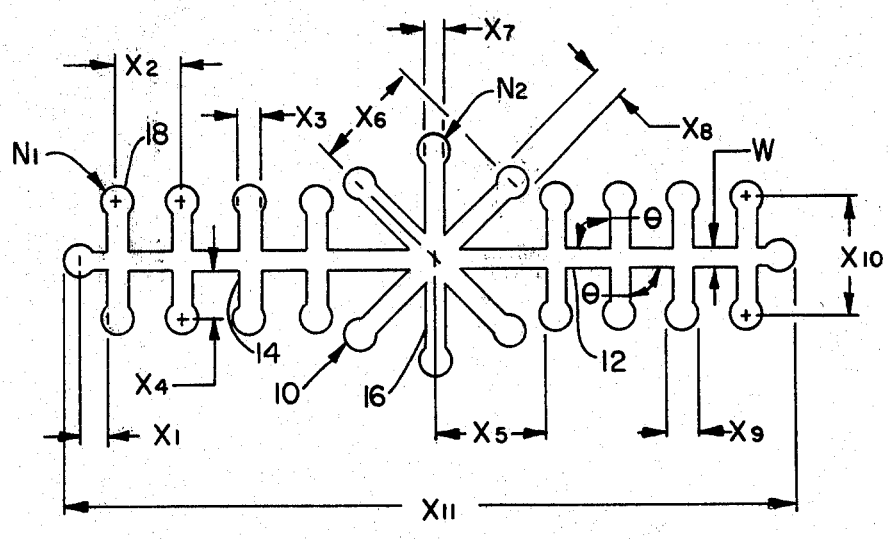
FIG. 1 illustrates a spinneret orifice cross-section having an elongated slot, a plurality of wing member bar slots and multiple intersecting body section bar slots, and showing the nature and location of typical measurements to be made.

In FIG. 1, 10 designates a spinneret orifice that would be formed in the planar cross-section of a spinneret. The planar cross-section of the spinneret orifice defines an elongated slot 12, which has a plurality of wing member bar slots 14 intersecting with the elongated slot at spaced intervals along the axial length of the elongated slot, and multiple intersecting body section bar slots 16 intersecting with the elongated slot 12 and intersecting with each of the other multiple intersecting body section bar slots at the elongated slot 12. The wing member bar slots 14 on one side of the elongated bar slot are in straight line alignment with the wing member bar slots on the other side of the elongated slot 12.

The multiple intersecting body section bar slots may also intersect at the center of the axial length of the elongated slot 12, and each body section bar slot has a greater length than the wing member bar slots 14.

It will be noted that the tips or extreme ends of the wing member bar slots and multiple intersecting body section bar slots are preferably rounded or are in the form of circular bores 18 which may have a greater diameter than the width of the wing member bar slots and body section bar slots. The purpose of these circular bores is to promote a greater flow of polymer through the thinner end portions of the spinneret orifice so that the cross-sections of the spinneret orifice will be filled out with polymer during spinning.

The number of spaced wing member bar slots 14, as shown in FIG. 1, may vary from four to twelve on each side of the multiple intersecting body section bar slots, and the number of multiple intersecting body section bar slots 16 may vary from two to eight.

In FIG. 1 the spaced wing member bar slots 14 intersect with the elongated slot at essentially right angles thereto or at an angle $\theta$ of essentially 90°.

As shown in FIG. 1, the width of the elongated slot 12, of the wing member bar slots 14 and of the multiple intersecting body section bar slots 16 is W, the dimension for which may vary from about 0.050 mm. to about 0.110 mm. The dimensional relationships and ranges of the various portions of the spinneret orifice cross-section are then given in terms of W as follows:

$X_1 = W$ to $3W$
$X_2 = 2W$ to $4W$
$X_3 = W$ to $1.5W$
$X_4 = 1.5W$ to $3W$
$X_5 = 3.5W$ to $7.5W$
$X_6 = 3W$ to $7W$
$X_7 = W$ to $1.5W$
$X_8 = W$ to $2.5W$
$X_9 = W$ to $2.5W$
$X_{10} = 4W$ to $7W$
$X_{11} = 2[W/2 + X_1 + X_3 + (N_1 - 1)X_2 + X_5]$

Figure 2:
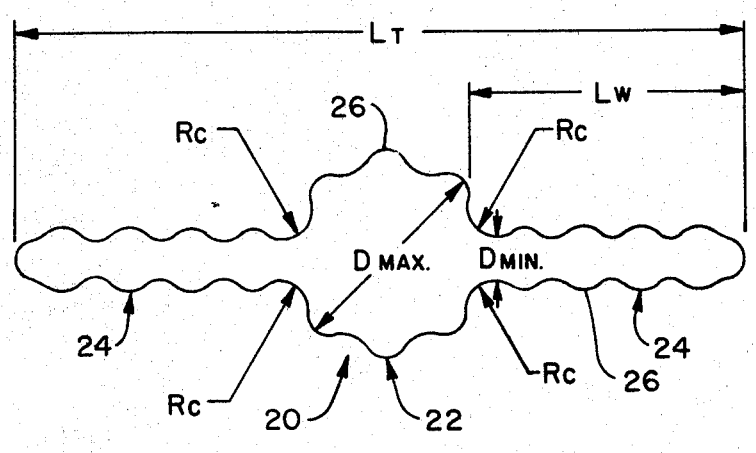
FIG. 2 is a drawing of a representative filament cross-section having a body section and two wing members and showing where the overall length of a wing member cross-section ($L_W$) and the overall or total length of a filament cross-section ($L_T$) are measured, where on the wing member the thickness (Dmin) of the wing member is measured, where on the body section the filament body diameter (Dmax) is measured and the locations of the radius of curvature (Rc)

Polymer emerging from each of the wing member bar slots and the multiple intersecting body section bar slots will form a lobe or undulation along the periphery of the resulting filament cross-section 20, as shown in FIG. 2. The number of wing member bar slots, $N_1$, along the axial length of the elongated slot on any one side of the multiple intersecting body section bar slots may vary from 4 to 12 when the wing member bar slots intersect the elongated slot on each side thereof with their respective intersections being directly opposite each other as shown in FIG. 1; and the number of multiple intersecting body section bar slots, $N_2$, may vary from 2 to 8. The purpose of these lobes or undulations is to reflect light in such manner that the fibers will not glitter, glitter being undesirable in men's fabrics, for instance.

The resulting filament cross-section 20 is characterized as having a body section 22 and one or more wing members 24 intersecting with the body section as shown in FIG. 2, and also having a plurality of lobes 26 along the peripheral surface of the filament cross-section. The radius of curvatures (Rc) are shown at the intersection of the wing member with the body section FIG. 3 shows a photomicrograph of a spinneret orifice 28 formed in a spinneret 30.

FIG. 4 illustrates a series of filament cross-sections 32 that were spun from the spinneret orifice of FIG. 3.

Figure 5:
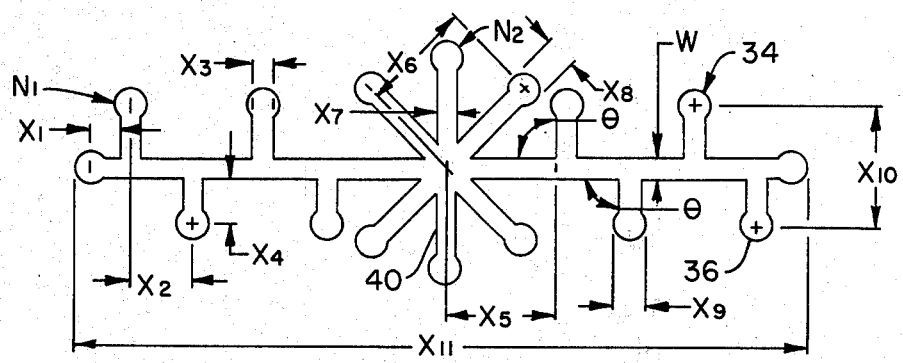
FIG. 5 illustrates a spinneret orifice cross-section similar to that shown in FIG. 1 except that the wing member bar slots on one side of the elongated slot are spaced at offset intervals with respect to those shown on the other side of the elongated slot.

FIG. 5 shows a different form of spinneret orifice 34 wherein the wing member bar slots 36 on one side of the elongated slot 38 are spaced at offset intervals with respect to those located on the other side of the elongated slot. The number of wing member bar slots, $N_1$, along the axial length of the elongated slot on any one side of the multiple intersecting body section bar slots may vary from 2 to 6 when the wing member bar slots are so spaced at offset intervals. The multiple intersecting body section bar slots 40 are shown constructed in the manner similar to that shown in FIG. 1, but may also be constructed in the manner shown by the different embodiments herein disclosed.

Figure 6:
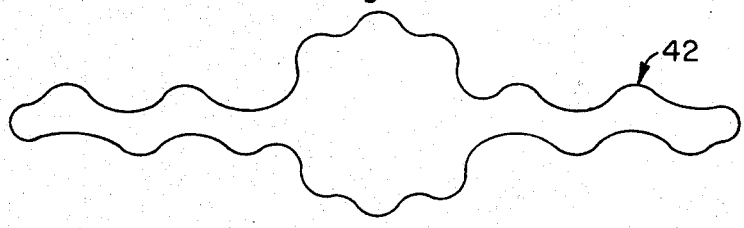
FIG. 6 illustrates the approximate configuration a filament cross-section will have when spun from the spinneret orifice shown in FIG. 5.

FIG. 6 illustrates approximately the filament cross-section 42 that is spun from the spinneret orifice cross-section shown in FIG. 5.

Figure 7:
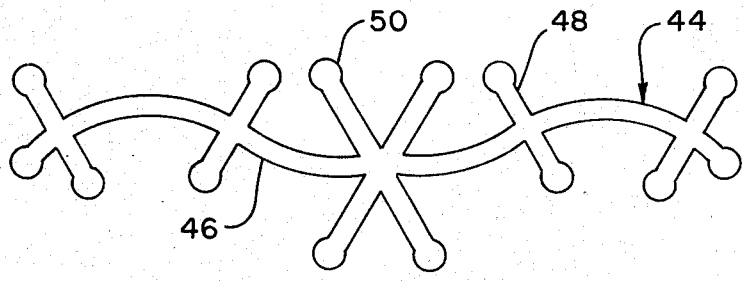
FIG. 7 illustrates a spinneret orifice cross-section where the elongated slot is nonstraight or curved.

FIG. 7 shows another form of spinneret orifice 44 where the axis of elongated slot 46 is nonstraight or curved; the number of wing member bar slots 48 and number of multiple intersecting body section bar slots 50 have been reduced from the number shown in FIG. 1.

Figure 8:
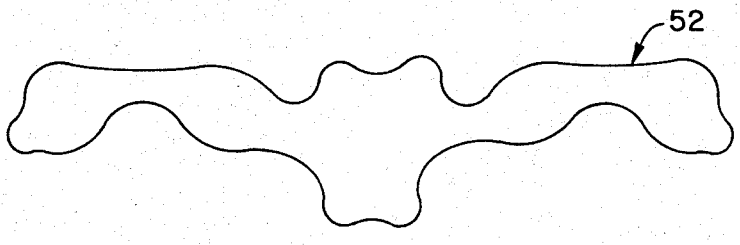
FIG. 8 illustrates the approximate configuration a filament cross-section will have when spun from the spinneret orifice cross-section shown in FIG. 7.

FIG. 8 illustrates approximately the filament cross-section 52 that is spun from the spinneret orifice cross-section shown in FIG. 7.

Figure 9:
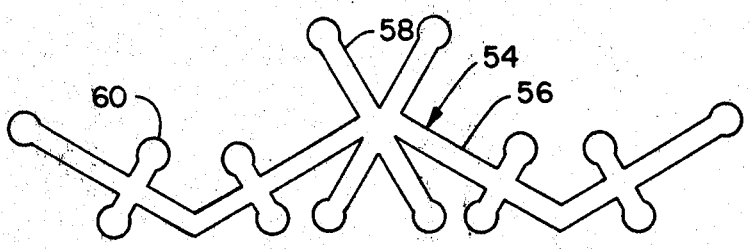
FIG. 9 illustrates a spinneret orifice cross-section where the elongated slot is nonstraight or angled.

FIG. 9 shows till another form of spinneret orifice 54 where the axis of the elongated slot 56 is nonstraight or the axial length of the elongated slot 56 on one side of the multiple intersecting body section bar slots 58 forms an angle of less than 180° with the axial length on the other side of the multiple intersecting body section bar slots 58; and a portion of the length of the elongated slot on one or both sides of the multiple intersecting body section bar slots may intersect with the adjacent remaining portion of such elongated slot length to form an angle of less than 180°. A wing member bar slot may also be formed to intersect on either side of the elongated slot at the intersection of these aforementioned two elongated slot length portions. At least one of the two angles that the wing member bar slot may make with the elongated slot at the intersection of the two elongated slot length portions may vary from about 30° to about 120°. The number of wing member bar slots 60 and multiple intersecting body section bar slots 58 have been reduced from the number shown in FIG. 1.

Figure 10:
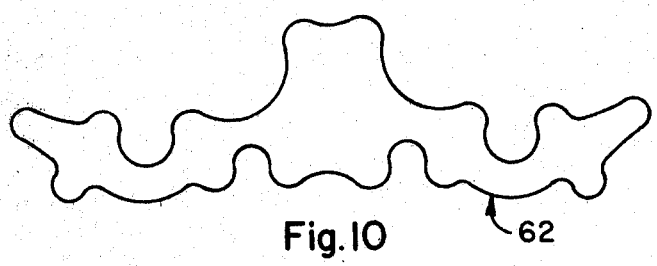
FIG. 10 illustrates the approximate configuration a filament cross-section will have when spun from the spinneret orifice cross-section shown in FIG. 9.

FIG. 10 illustrates approximately the filament cross-section 62 that is spun from the spinneret orifice cross-section shown in FIG. 9.

Figure 11:
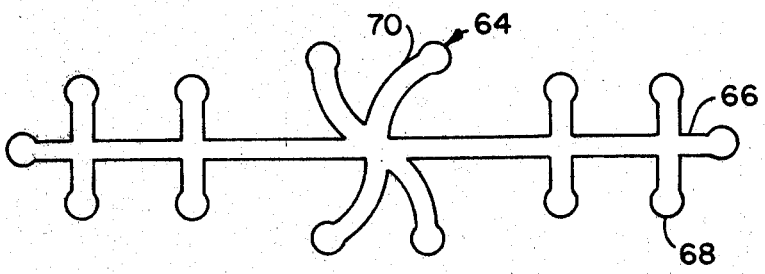
FIG. 11 illustrates a spinneret orifice cross-section where the multiple intersecting body section bar slots are nonstraight or curved.

FIG. 11 shows a still different form of spinneret orifice 64 where the elongated slot 66 is straight, the wing member bar slots 68 are spaced at intervals along the elongated slot and each multiple intersecting body section bar slot 70 is nonstraight or curved.

Figure 12:
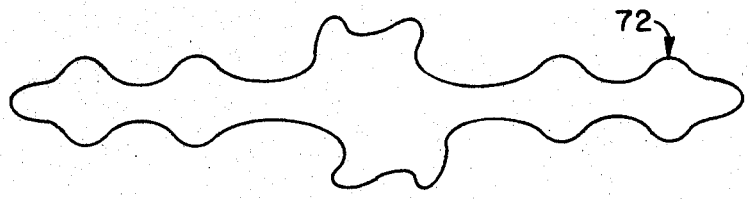
FIG. 12 illustrates the approximate configuration a filament cross-section will have when spun from the spinneret orifice cross-section shown in FIG. 11.

FIG. 12 illustrates approximately the filament cross-section 72 that is spun from the spinneret orifice cross-section shown in FIG. 11.

Figure 13:
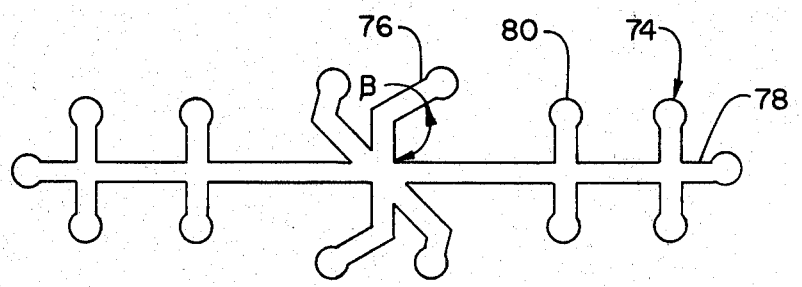
FIG. 13 illustrates a spinneret orifice cross-section where the multiple intersecting body section bar slots are nonstraight or angled.

FIG. 13 shows still another different form of spinneret orifice 74 where each of multiple intersecting body section bar slots 76 is nonstraight, and a portion of the length of each multiple intersecting body section bar slots forms an angle $\beta$ of less than 180° with the remaining portion at each multiple intersecting body section bar slot. The angle $\beta$ may vary from 45° to 175°. The wing member bar slots 80 are spaced at intervals along the elongated slot.

Figure 14:
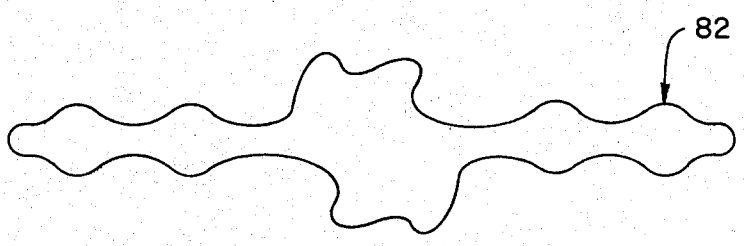
FIG. 14 illustrates the approximate configuration a filament cross-section will have when spun from the spinneret orifice cross-section shown in FIG. 13.

FIG. 14 illustrates approximately the filament cross-section 82 that is spun from the spinneret orifice cross-section shown in FIG. 13.

Figure 15:
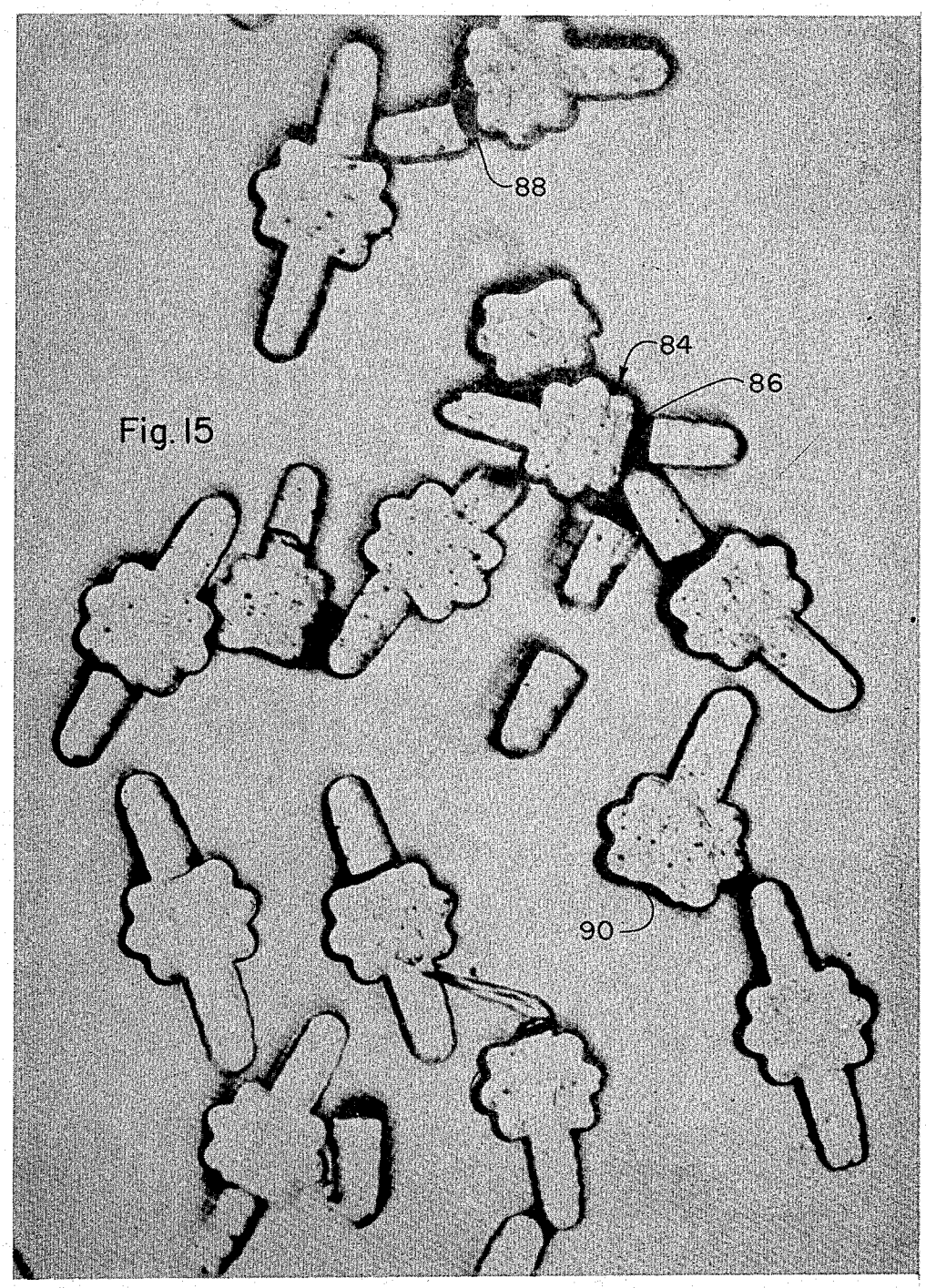
FIG. 15 is a photomicrograph of filament cross-sections illustrating where fracturing occurs with some of the cross-sections.

In reference to FIG. 15, the photomicrograph shows other filament cross-sections 84 where some of the filament cross-sections have been fractured as at 86, 88 and 90.

Figure 16:
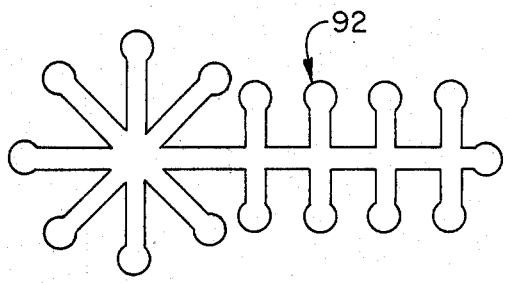
FIG. 16 is a spinneret orifice cross-section where the multiple intersecting body section bar slots intersect the elongated bar at a location spaced along the elongated slot length from the center of such length.

FIG. 16 illustrates a spinneret orifice 92 that will produce a filament cross-section having only a single wing member, i.e. the multiple intersecting bar slots intersect the elongated slot at a location spaced from the center of the axial length of the elongated slot.

Figure 17:
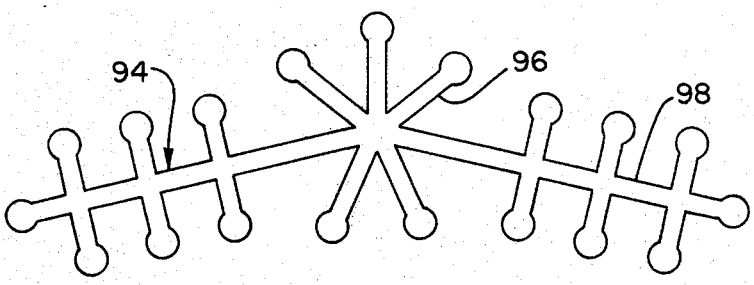
FIG. 17 is a spinneret orifice cross-section where the multiple intersecting body section bar slots are an odd number and none of them on one side of the elongated slot are in co-alignment with any of the other multiple intersecting body section bar slots on the other side of the elongated slot.

FIG. 17 illustrates a spinneret orifice 94 wherein the multiple intersecting body section bar slots 96 on one side of the elongated slot 98 are nonaligned with the multiple intersecting body section bar slots on the other side of the elongated slot. The body section bar slot shown in FIG. 17 at the 12 o'clock position forms at least one angle with the elongated slot greater than 90°; such angle may vary from about 60° to about 120°. The number of body section bar slots is shown to be an odd number, and the body section bar slots are shown equally spaced angularly with respect to each other and to the elongated slot 98. Obviously, however, it should be recognized that the multiple intersecting body section bar slots may be nonequally angularly spaced.

Figure 18:
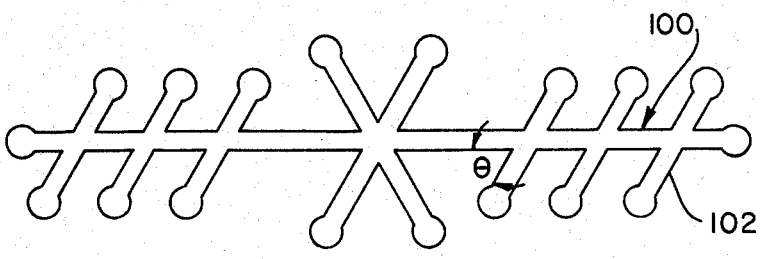
FIG. 18 illustrates a spinneret orifice cross-section where the wing member bar slots intersect with the elongated slot at an angle other than 90°.

FIG. 18 illustrates a spinneret orifice 100 where the wing member bar slots 102 intersect with the elongated slot at an angle $\theta$ other than 90°. The wing member bar slots on one side of the elongated slot are shown in alignment with the wing member bar slots on the other side of the elongated slot, or in other words, they intersect at locations along the elongated slot directly opposite each other. The angle $\theta$ for one of the two angles at the intersection may vary from about 30° to about 120°.

Figure 19:
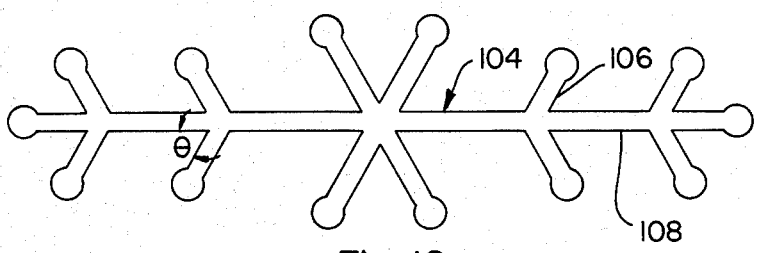
FIG. 19 illustrates another embodiment of a spinneret orifice cross-section where the wing member bar slots intersect with the elongated slot at an angle other than 90° and the intersections of the wing member bar slots on one side of the elongated slot are directly opposite the intersections of the wing member bar slots on the other side of the elongated slot.

FIG. 19 illustrates another embodiment of a spinneret orifice 104 where the wing member bar slots 106 intersect with the elongated slot 108 at an angle other than 90°, which angle $\theta$ for one of the two angles at the intersection may vary from about 30° to about 120°, and the wing member bar slots on one side of the elongated slot are in nonalignment with the wing member bar slots on the other side of the elongated slot, or in other words their respective intersections along the elongated slot are directly opposite each other.

Figure 20:
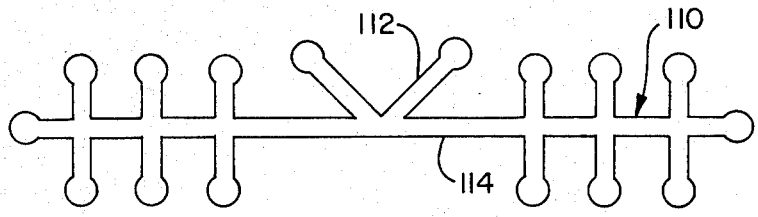
FIG. 20 illustrates a spinneret orifice cross-section where the multiple intersecting bar slots are shown on only one side of the elongated slot.

FIG. 20 illustrates a spinneret orifice 110 where the multiple intersecting bar slots 112 are shown on only one side of the elongated slot 114.

The invention has been described in detail with particular reference to preferred embodiments thereof, but it will be understood that variations and modifications can be effected within the spirit and scope of the invention.

I claim:

1. A spinneret defining at least one spinneret orifice the planar cross-section of which defines an elongated slot having a plurality of wing member bar slots intersecting with said elongated slot at spaced intervals along the axial length thereof; and multiple intersecting body section bar slots intersecting with said elongated slot and intersecting with each of the other multiple intersecting body section bar slots at said elongated slot.

2. A spinneret as defined in claim 1 wherein a wing member bar slot on one side of the elongated slot is in straight line alignment with a wing member bar slot on the other side of the elongated slot.

3. A spinneret as defined in claim 1 wherein a wing member bar slot intersects with the elongated slot and one of the two angles at the intersection may vary from about 30° to about 120°.

4. A spinneret as defined in claim 1 wherein said wing member bar slots intersecting with one side of the elongated slot are spaced at offset intervals with respect to the wing member bar slots intersecting with the other side of the elongated slot.

5. A spinneret as defined in claim 4 wherein the number of said spaced offset wing member bar slots varies from two to six on any one side of said multiple intersecting body section bar slots.

6. A spinneret as defined in claim 1 wherein said wing member bar slots intersecting with one side of the elongated slot have their intersections at the same respective locations as the intersections of the wing member bar slots intersecting with the elongated slot on the other side thereof.

7. A spinneret as defined in claim 6 wherein the number of said wing member bar slots having their intersections at said same respective locations varies from four to twelve on any one side of said multiple intersecting body section bar slots.

8. A spinneret as defined in claim 4 and as exemplified in FIG. 5, wherein the number of wing member bar slots, $N_1$, on any one side of said multiple intersecting body section bar slots is 2 to 6, and the number of multiple intersecting body section bar slots, $N_2$, is 2 to 8, and $W=0.050$ to 0.110 mm.

$X_1=W$ to 3W $X_2=2W$ to 4W $X_3=W$ to 1.5W $X_4=1.5W$ to 3W $X_5=3.5W$ to 7.5W $X_6=3W$ to 7W $X_7=W$ to 1.5W $X_8=W$ to 2.5W $X_9=W$ to 2.5W $X_{10}=4W$ to 7W $X_{11}=2[W/2+X_1+X_3+(N_1-1)X_2+X_5]$.

9. A spinneret as defined in claim 6 and as exemplified in FIG. 1 wherein the number of wing member slots, $N_1$, on any one side of said multiple intersecting body section bar slots is 4 to 12, and the number of multiple intersecting body section bar slots $N_2$, is 2 to 8, and $W=0.050$ to 0.110 mm.

$X_1=W$ to 3W $X_2=2W$ to 4W $X_3=W$ to 1.5W $X_4=1.5W$ to 3W $X_5=3.5W$ to 7.5W $X_6=3W$ to 7W $X_7=W$ to 1.5W $X_8=W$ to 2.5W $X_9=W$ to 2.5W $X_{10}=4W$ to 7W $X_{11}=2[W/2+X_1+X_3+(N_1-1)X_2+X_5]$.

10. A spinneret as defined in claim 1 wherein a body section bar slot on one side of the elongated slot is in straight line alignment with a body section bar slot on the other side of the elongated slot.

11. A spinneret as defined in claim 1 wherein a body section bar slot intersects with the elongated slot and one of the two angles at the intersection may vary from about 30° to about 120°.

12. A spinneret as defined in claim 1 wherein said multiple intersecting body section bar slots intersect at the center of the axial length of said elongated slot.

13. A spinneret as defined in claim 1 wherein said multiple intersecting body section bar slots intersect said elongated slot at a location spaced from the center of the axial length of said elongated slot.

14. A spinneret as defined in claim 1 wherein said multiple intersecting body section bar slots each have a greater length than said spaced wing member bar slots.

15. A spinneret as defined in claim 1 wherein the number of multiple intersecting body section bar slots varies from two to eight.

16. A spinneret as defined in claim 1 wherein said elongated slot is nonstraight.

17. A spinneret as defined in claim 16 wherein said elongated slot is curved.

18. A spinneret as defined in claim 16 wherein the length of said elongated slot on one side of said multiple intersecting body section bar slots forms an angle of less than 180° with the length of said elongated slot on the other side of said multiple intersecting body section bar slots.

19. A spinneret as defined in claim 18 wherein a portion of said length of said elongated slot on said one side forms an angle of less than 180° with the adjacent remaining portion of said elongated slot length on said one side.

20. A spinneret as defined in claim 1 wherein one or more of the body section bar slots is or are nonstraight.

21. A spinneret as defined in claim 15 where one or more of the body section bar slots is or are curved.

22. A spinneret as defined in claim 20 wherein a portion of the length of at least one body section bar slot forms an angle with the remaining portion of said at least one body section bar slot of less than 180°.

23. A spinneret as defined in claim 1 wherein the extremities of said wing member bar slots and of said multiple intersecting body section bar slots define circular bores.

24. A spinneret as defined in claim 23 wherein the circular bores of said body section bar slots are of greater diameter than the circular bores of said wing member bar slots.

* * * * *